US005652984A

United States Patent [19]

Korb

[11] Patent Number: 5,652,984

[45] Date of Patent: Aug. 5, 1997

[54] MATTRESS HANDLE

[76] Inventor: Lothar Korb, 22 Burningham Crescent, Ajax, Ontario, Canada, L1S 6A2

[21] Appl. No.: 503,918

[22] Filed: Jul. 19, 1995

[51] Int. Cl.[6] ..... A47C 31/08

[52] U.S. Cl. ..... 5/703; 29/91.1

[58] Field of Search ..... 5/466; 29/91–91.4, 29/464, 468, 243.5; 403/315, 319; 411/508, 456

[56] References Cited

U.S. PATENT DOCUMENTS

| | | | |
|---|---|---|---|
| 2,248,328 | 7/1941 | Bechik | 5/446 |
| 2,584,842 | 2/1952 | Caster | 5/466 |
| 2,703,415 | 3/1955 | Bechik | 5/466 |
| 3,579,773 | 5/1971 | Zysman | 29/91.1 |
| 3,590,415 | 7/1971 | Kerr | 5/466 |
| 5,214,810 | 6/1993 | Ward | 5/466 |

FOREIGN PATENT DOCUMENTS

| | | | |
|---|---|---|---|
| 313902 | 11/1961 | France | 5/466 |

*Primary Examiner*—Flemming Saether

*Attorney, Agent, or Firm*—Robert L. Westell; Dowell & Dowell

[57] ABSTRACT

A handle for a mattress border is anchored with spaced grommets in the border against which anchors on the handle ends may bear. The anchors are designed to allow the handle to be drawn through the grommet openings when the latter are aligned. A back strap between the grommet openings is shaped to allow clamping to move the grommet openings to aligned position.

7 Claims, 8 Drawing Sheets

MATTRESS HANDLE

Figure 1:
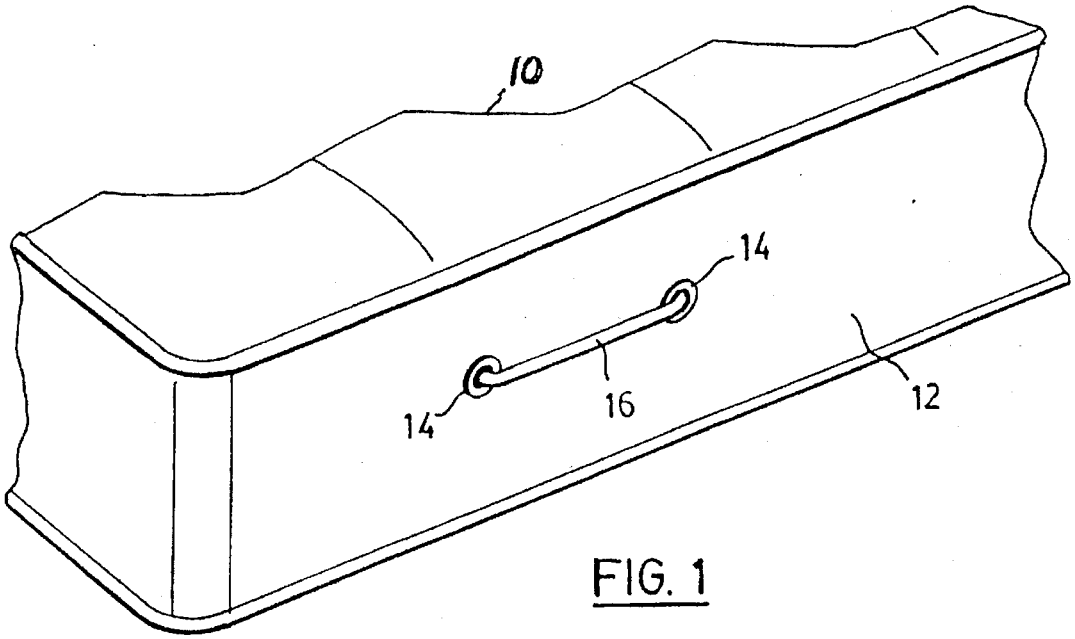

This invention relates to a mattress handle assembly and to components associated therewith, individually and collectively designed to allow efficient attachment of the handle to the mattress and allowing such efficient attachment to be achieved by machine.

A mattress typically comprises a resilient core and a cover including top and bottom layers joined about their periphery by a border, the handle is attached to the mattress border before the attachment of the top and bottom layers to the mattress border. Hence the description to follow deals with the attachment of the handle to the border.

Typically, the handle has a flexible extent having at each end anchors including a clip extending toward the other end while diverging from the flexible extent. The mattress border is provided with a pair of spaced apertures to receive the handle anchors. The spaced apertures are preferably defined by grommets. The grommets, in addition to attachment to the mattress border, preferably attach a back strap to the inside of the mattress border.

The grommet openings coincide with openings in the back strap.

The handle anchors extend from outside to inside of the border through the grommet openings and clips on the anchor prevent their outward removal.

Under lifting pulls on the handle the clips bear on the back strap to transfer the lifting force from the handle to the mattress border.

A good example of the handle described above is shown in U.S. Pat. No. 2,703,415; dated Mar. 18, 1955 to Bechik.

Presently the handle is manually attached to the grommets (and hence, to the mattress border and back strap) by inserting each anchor through the grommet, from outside to inside with the clip deflected inward in passage to pass through the grommet. The clip then extends outwardly to hold the handle in place.

It is an object of this invention to provide a handle having the clip attachment means as used with the prior handles but which allows efficient attachment and preferably attachment by machine methods.

It is an object of this invention to provide coupling means on the anchor at, at least one end (the coupling end) of the handle allowing cooperation with a pulling tool so that the pulling tool may extend through the grommet openings when the latter are aligned, and pull the coupling end anchor through the two grommet openings to install the handle. To align the grommets, the mattress border is bent into a U shape with the inside of the mattress border on the outside of the "U".

Preferably the grommets attach a back strap to the inside of the mattress border. The back strap has two spaced openings and at each opening is attached by the grommet to the inside of the mattress border. Thus when the handle, after installation, is used to pull or lift the mattress, the back strap assists in transferring the pulling force from the handle to the mattress border.

It is an object of this invention to provide such a back strap which is particularly shaped to allow gripping by clamping members adjacent each grommet opening, to allow bending of the mattress border and back strap to align the openings.

It is an object of this invention to provide a handle whose anchors will, at each end, extend through apertures in the mattress border, wherein the handle is designed so that its leading end may be drawn through the two apertures, (when aligned) so that the handle is tbereby installed.

It is an object of the invention to provide that at least one, and preferably each, end of the handle is provided with a coupling member for coupling to a pulling tool so that the leading end of the handle when coupled thereto may be pulled through the grommet apertures when aligned.

It is an object of the invention to provide anchors complete with coupling means, for attachment to the handle, which may be formed from a flat blank having the spring clip at the end to be nearest the remote anchor, a middle portion for crimping about the handle, and at the end remote from the remote anchor, coupling means in a section preferably U shaped as viewed in section longitudinally of the handle.

The area with the U shaped section has a middle portion and two outer portions, and the middle portion is provided with coupling means, preferably a tab diverging toward the remote anchor, for coupling to a pulling member for drawing the leading end of the handle through the grommet openings.

Overall, it will be noted that the handle with leading anchor coupled to the pulling tool must have a profile to pass through the grommet openings.

Figure 2:
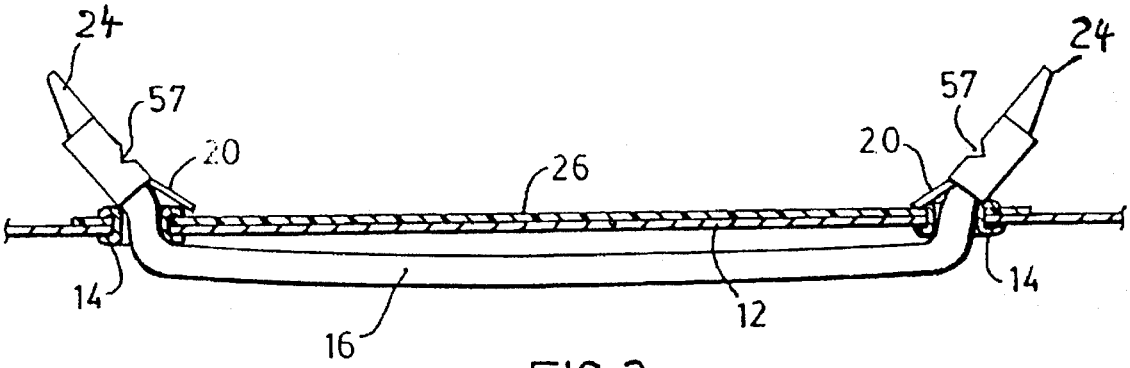
Figure 3:
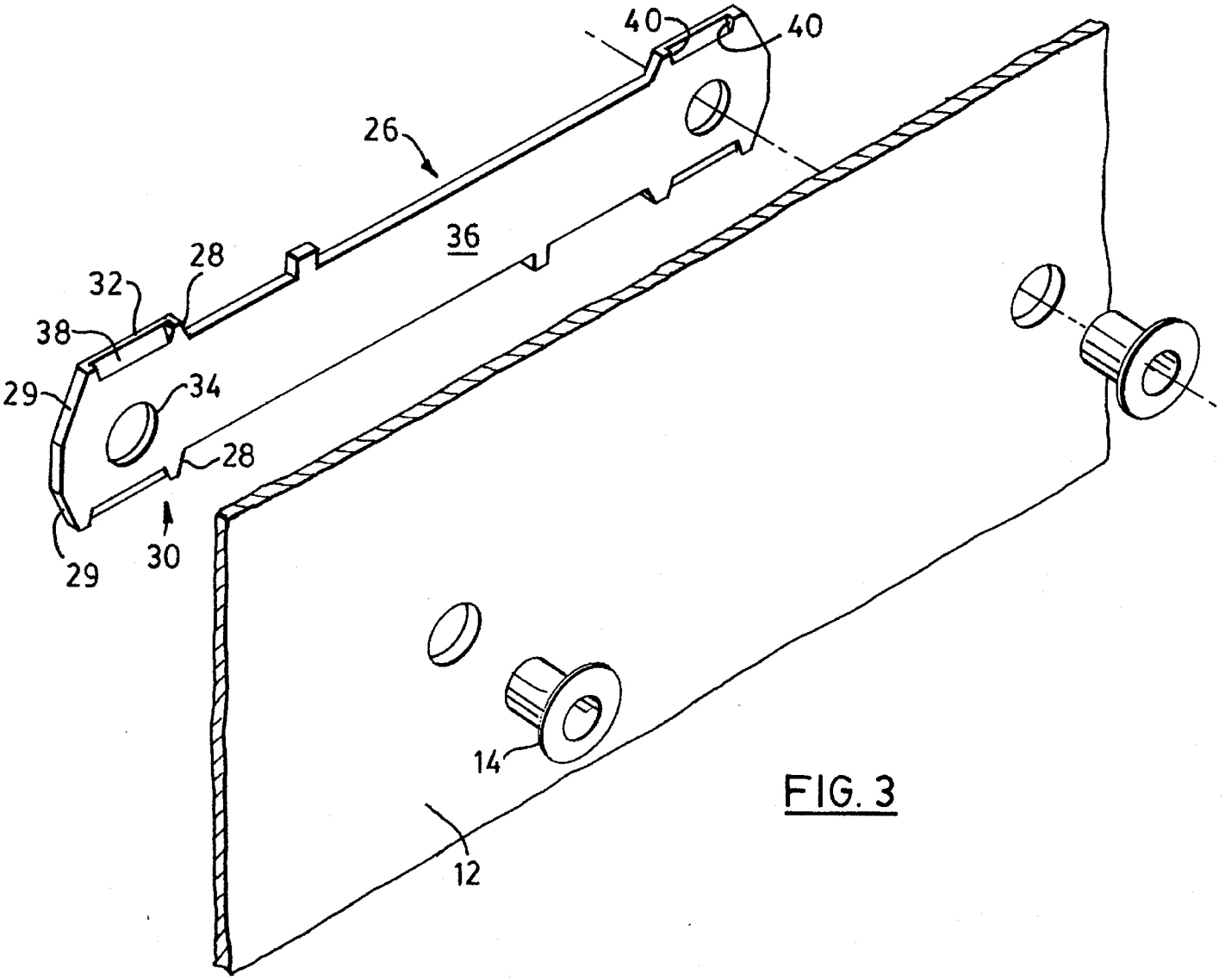
Figure 4:
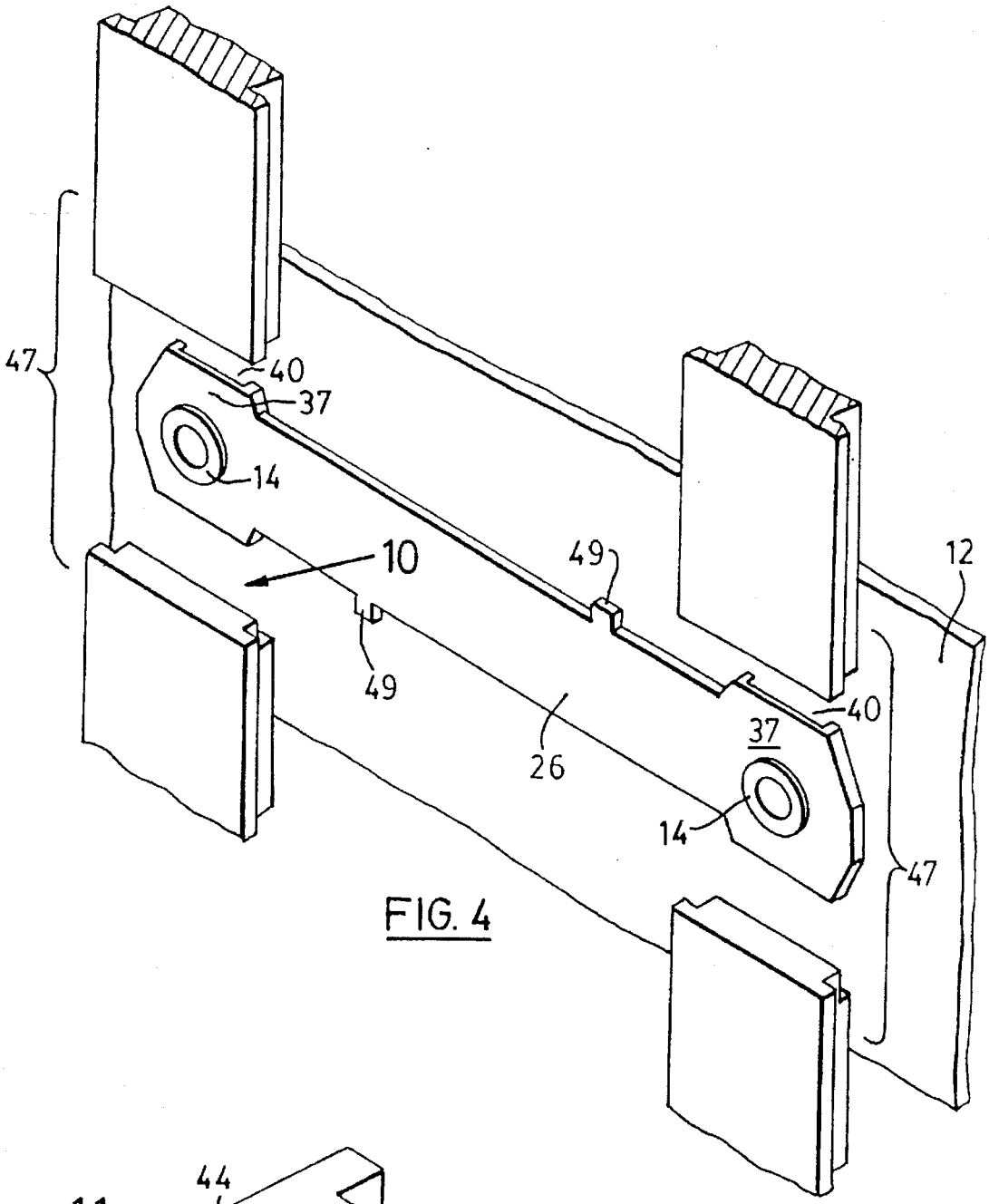
Figure 10:
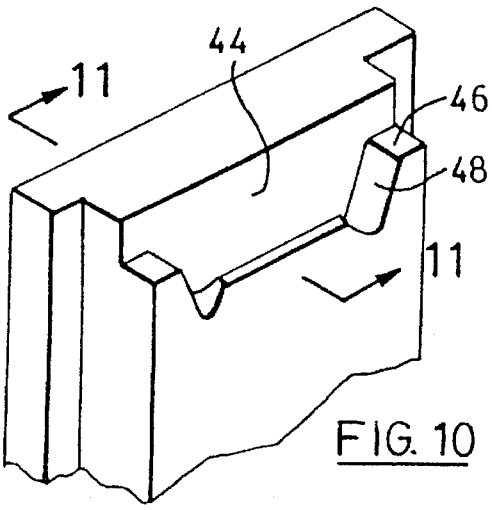
Figure 11:
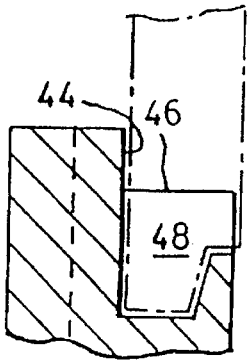
Figures 5, 6:
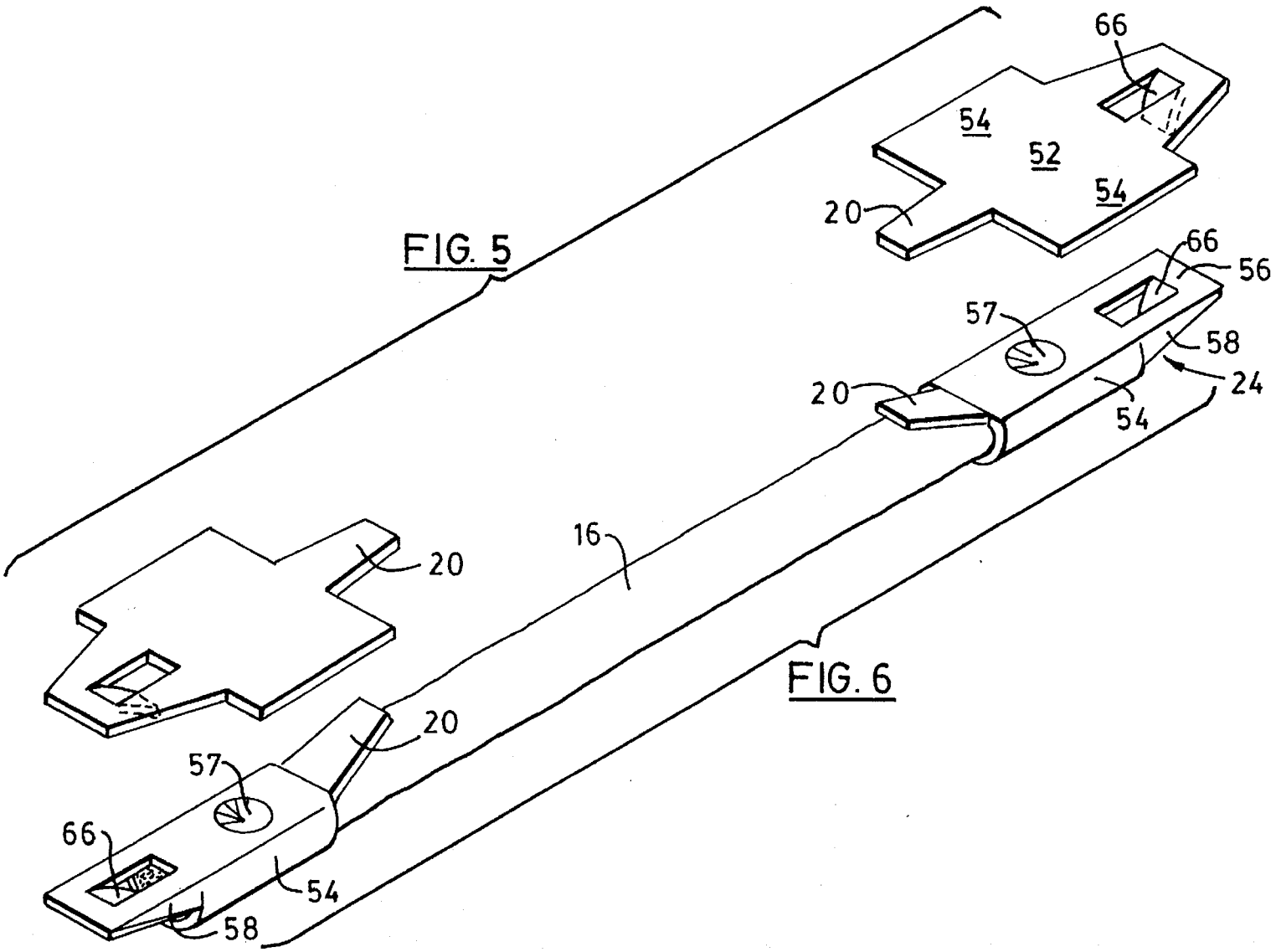
Figure 7:
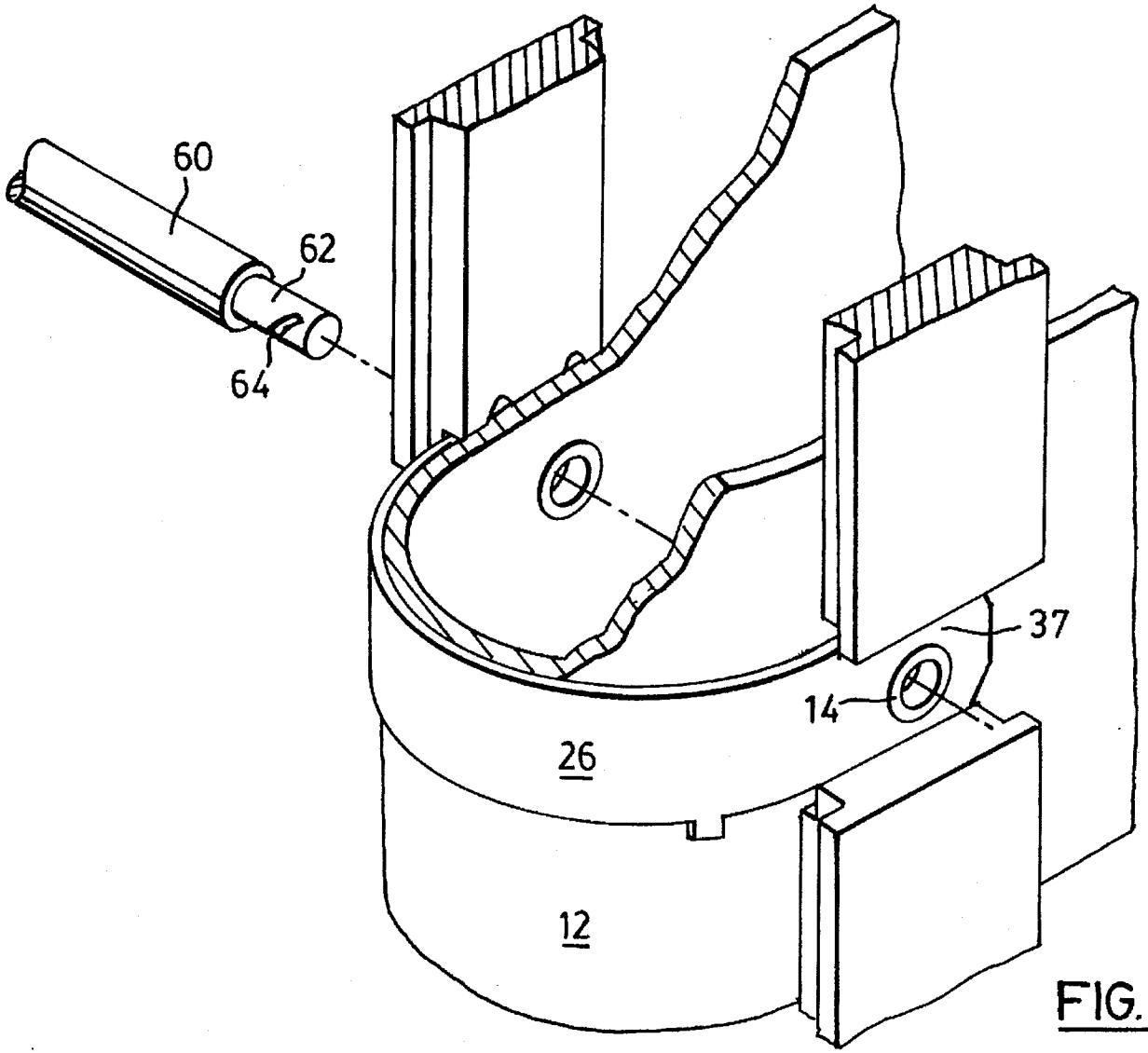
Figures 8, 13:
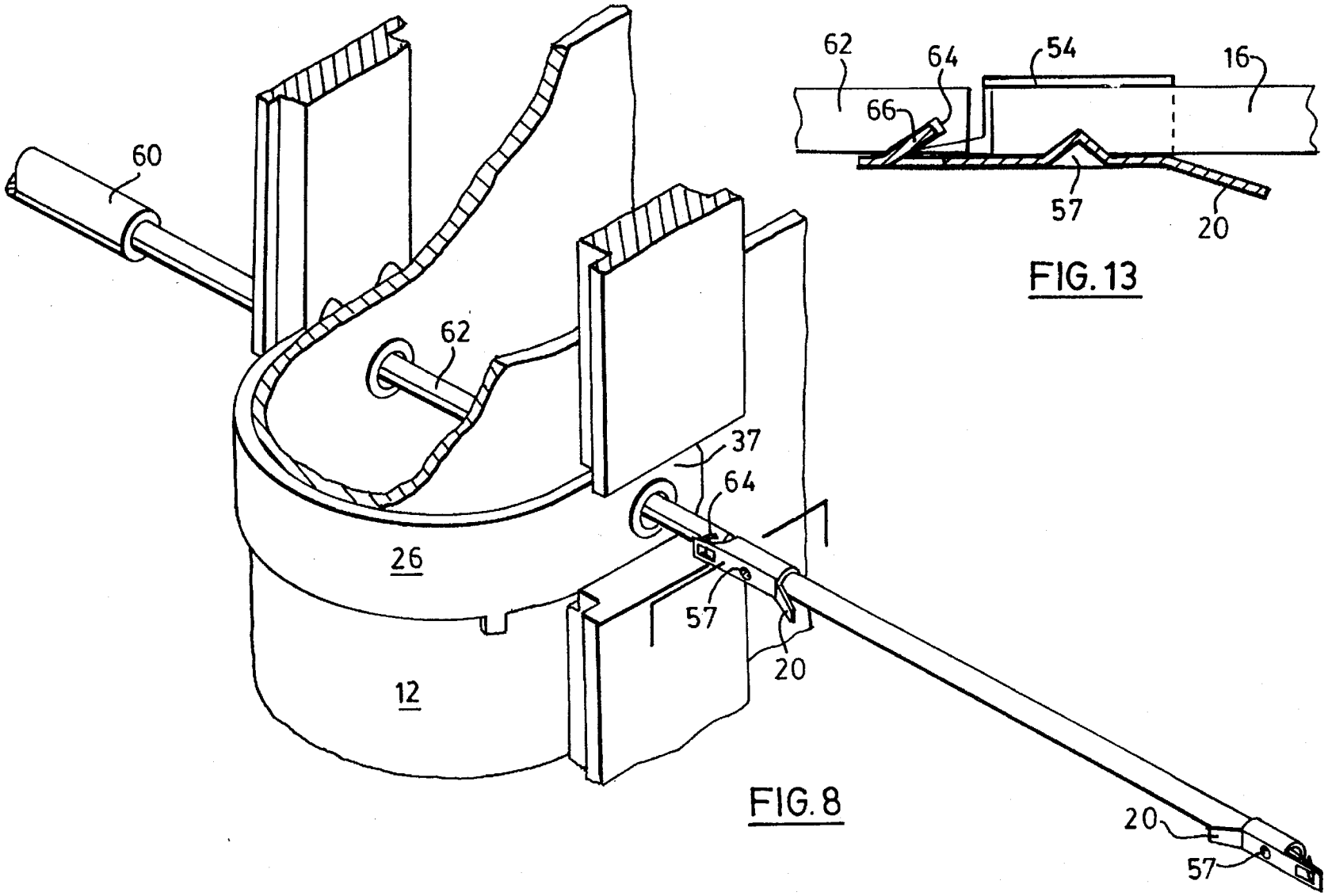
Figure 9:
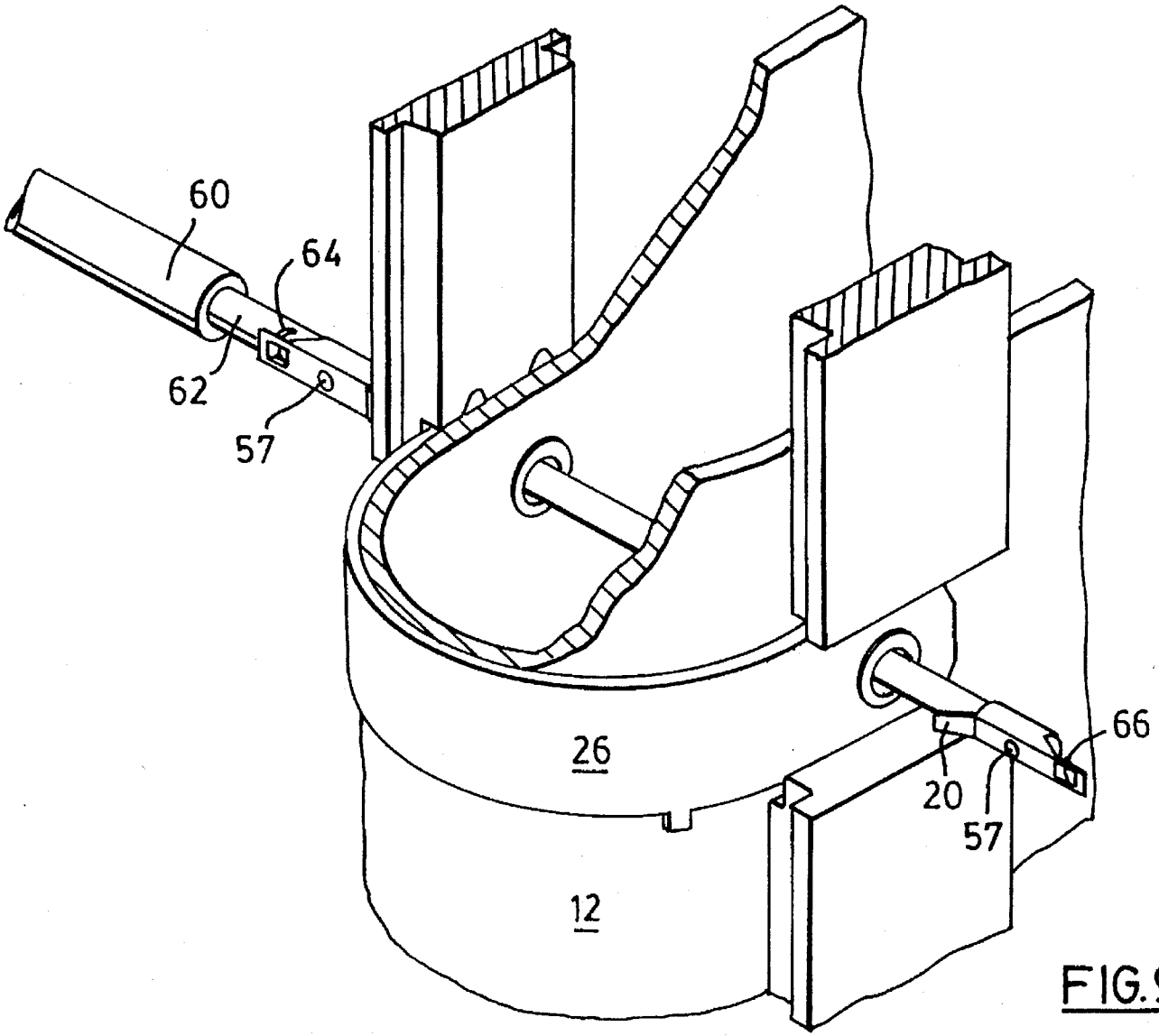
Figure 12:
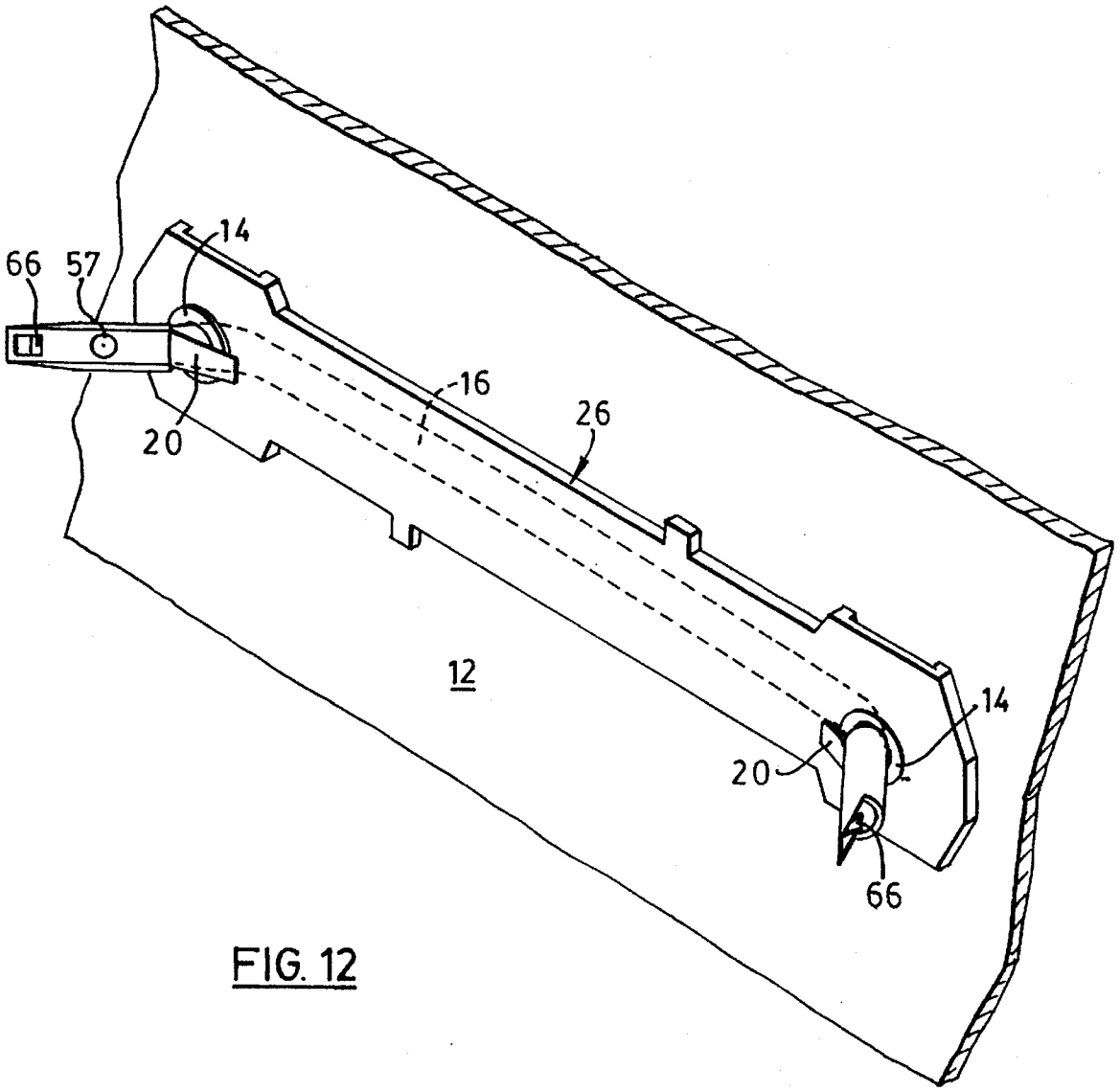

In drawings which illustrate a preferred embodiment of the invention:

FIG. 1 shows part of the outside of a mattress with a handle, in accord with the invention, attached to the mattress border of the mattress, FIG. 2 is a section through the mattress border showing a handle, in accord with the invention, installed therein, FIG. 3 is an exploded view of a portion of the mattress border with grommets for attachment of a back strap thereto, FIG. 4 is a schematic view showing clamping members for clamping engagement with a back strap which is shaped in accord with the invention, FIG. 5 shows the blanks for forming inventive anchor members, FIG. 6 shows the blanks of FIG. 5 formed on each end of a handle, FIG. 7 shows the mattress border and back strap formed to align the grommet openings, FIG. 8 is a schematic view showing the pulling tool positioned to pull the handle leading end through the aligned openings, with the handle following, FIG. 9 shows the pulling tool completing the motion of drawing the handle through the openings, FIG. 10 shows the end of one of the clamping members, FIG. 11 is a section of a clamping member in clamping engagement with a back strap, FIG. 12 shows the view of an installed handle from inside the mattress border, and FIG. 13 is an enlarged view of the coupling means.

In FIG. 1 is shown a mattress having a top 10, a bottom (not shown) joined about their peripheries by a mattress border 12. At spaced location (only one is shown) about the mattress border, are pairs of apertures defined by grommets 14. Extending through the apertures are the respective ends of a handle 16. The invention herein describes operations of installing the handle in the mattress border member before the top and bottom are attached to the mattress border.

As shown in FIG. 2 the handle is a flexible member, usually a resilient core with a braided cover. Crimped on to each end of the flexible member is a metal end member which includes a clip 20 diverging from the flexible member in the direction toward the other anchor, and coupling extension 24, all to be described hereafter.

In FIG. 2, it will be noted that grommet 14 in addition to defining the apertures for the passage of the handle also attaches a flexible back strap 26 to be hereinafter described.

However, it may be noted that with the handle installed as shown in FIG. 2, a pull on the handle will move the mattress because the clips extend to retain it in position and the back strap 26 distributes the handle pull to the border, FIG. 3 shows the back strap 26 having widened ends surrounding grommet apertures 34, which widened ends, on each side of the back strap, are defined by converging edges 28 and 29 terminating at edge 32. Back strap 26 has outer surface 36 which will rest against the inside of mattress border 12. ("Outer" and "inner" herein refer to the outer and inner surfaces of the mattress border).

Chamferred areas 38 on the outer back strap side extend over the widened portions of ends 30 to edges 32, the area 38 sloping outwardly in the direction toward the apertures 34. At each end of chamferred edges 38 are opposed shoulders 40 which converge slightly from the edges 32 toward the longitudinal median of the back strap.

FIG. 4, 10, and 11 show the facing ends of opposed clamping bars 44 which facing ends are shaped to complement the side surfaces of the widened back strap ends. As best shown in FIG. 10, the lower end surface 46 of each clamping bar is stepped back so that surface 44 may ride over the inner surface of one side of the widening of back strap 26. The surface 46 is recessed to provide tapering surfaces 48 which complement walls 28 and 29 (FIG. 3) and define a recess shaped to complement and receive chamferred surface 38, edge 32, and opposing inner surface 37 of back strap 26 and edge 32. It will be seen that, when the clamping bars are moved to opposite sides of the back strap enlargement, they are guided into a clamping position, and the clamping bars as a pair, may, by means not shown, bend the back strap and mattress border from the position where the back strap 26 and mattress border 12 are straight (FIG. 4) to the position (FIG. 7) where mattress border and back strap have been bent so that the eyelets of grommets 14 are aligned.

FIG. 5 demonstrates the formation of the handle and anchors.

The anchors are attached to each end of the handle by crimping anchor blanks thereabout.

Tabs 49 project from opposite sides of the back strap adjacent respectively opposite ends. These are provided so that if there is an attempt to apply the back strap wrong side up, it may be detected.

It is very desireable for economy and efficiency that the anchors be designed to be stamped as a blank from a flat sheet of metal. The anchor blanks are shown in FIG. 5. Projecting from one end of the anchor blank to be nearest the remote end a tapering trapezoidal clip 20, designed, as shown in FIG. 6, to be bent to slope outwards in the direction toward the other end of the handle. The middle portion of the anchor blank nearer the clip has a central portion 52 with two outwardly extending wings 54 which, as shown in FIG. 6, are bent to crimp the end member to the resilient handle extent. The tapering portion of the blank at the end remote from the clip is bent into a U section, as shown in FIG. 6 with central portion 56 which is provided with an aperture and a tab 66 adapted when bent to extend inwardly toward the remote anchor, while diverging from the handle extent.

A dimple or depression 57 is made at the line of attachment of the anchor to the handle to give more positive attachment.

As shown in FIGS. 7, 8, and 9, a sleeve 60 is designed to house a pulling tool 62 for reciprocal movement therein. The pulling tool 62 is provided with a slot 64 at its outer end. The slot extends inwardly from the surface of the pulling tool, adjacent its end, and slopes in such inward extension toward the end. The slope and dimension of the slot is designed to receive the tab 66 therein.

In operation, the back strap 26 is attached to the inside of the border by grommets 14. The clamping bar pairs are used to clamp each end of the back straps and bend, by any one of a number of means not shown but well within the scope of those skilled in the art, to the "U" position of FIG. 7, with the outside of the mattress border on the concave side of the U. The pulling tool 62 with its slot 64 may then be extended through the aligned grommet apertures. When so extended the hook slot 64 is adapted to be coupled to the adjacent tab 66 (FIG. 13). In so coupling it will be noted that the side walls 58 which taper from the member 54 to the face end of the end member, guide the pulling tool 62 into line with the anchor and a longitudinally extending handle. It will be noted that pulling tool and handle should be oriented about their longitudinal axis so that clips 20 face the edge of the grommet nearest the other grommet. With tab 66 in slot 64 the pulling tool 62 may be withdrawn to the position shown in FIG. 9. The leading clip 20 tilts slightly to pass through the grommet openings due to the yielding of the handle material. Thus the clip 20 on the leading end has passed through each grommet opening, being deflected as it passes each opening. The handle is then retained by a clip 20 at each end which prevents withdrawal of the handle in either direction from the mattress border. The tab 66 is then removed from slot 64; and pulling tool 62 removed, and the mattress border, back strap and handle allowed to assume straight position with the handle installed as shown in FIG. 12.

Although the coupling means between the pulling tool 62 and the anchor described previously is preferred, any coupling means may be used within the scope of the invention which allows: insertion of the pulling tool through aligned grommet openings, coupling to the anchor which is to be at the leading end of the handle, and pulling the leading end through the aligned grommet openings. It is implied in the above statements that the alternate coupling means has the profile to pass through the grommet openings, when coupled to the anchor.

It is also within the scope of the invention to use any alternate shaping of the back strap which can be clamped to allow the back strap, with boundary material, to be bent to align the grommet openings.

I claim:

1. A combination comprising:

a handle assembly and a mattress border, said handle assembly comprising:

a longitudinally extending flexible handle extent having two ends, an anchor attached to each extent end, each said anchor including a clip, diverging from the attached extent end in the direction toward the other anchor, first coupling means on at least one of said anchors, said mattress border comprising:

border material having an inner and an outer surface, a pair of spaced first apertures in said border material, a grommet attached to said border material to surround each said first aperture, a flexible back strap, located on the inside surface of said material, said back strap having a pair of second apertures, said back strap being attached to said border material by each grommet and located thereby so that each second aperture aligns with a first aperture to form an aligned set of apertures; in further combination with a pulling tool having a second coupling, means coupling with said first coupling means wherein said pulling tool is dimensioned to pass through each aligned set.

2. A handle assembly as claimed in claim 1, wherein said anchor at said at least one end is formed from a flat blank defining said clip at its end nearest the remote anchor, a middle portion with crimping areas crimped about said handle, and coupling means at its end remote from the remote anchor.

3. A handle assembly as claimed in claim 1 wherein said coupling means comprises a tab extending from said at least one anchor extending toward the other anchor.

4. A combination as claimed in claim 1 having a plurality of clamping surfaces on said back strap adjacent each of said grommets, said clamping surfaces allowing the clamping of each plurality by clamping means to each of said pluralities.

5. A mattress border with border material defining an inner and an outer surface, said border having spaced grommets therein, a flexible back strap having an outer side and a spaced pair of back strap apertures, said back strap fixed on said inner surface of said mattress border by said grommets, a plurality of chamferred clamping surfaces on the outer side of said back strap, adjacent each of said grommets, each said plurality of clamping surfaces allowing the clamping of clamping means to said surfaces.

6. The method of installing a handle in a mattress border, wherein said handle assembly comprises a longitudinally extending flexible handle extent having two ends, an anchor attached to each extent end, each said anchor including a clip, diverging from the extent end in the direction toward the outer anchor, first coupling means on said anchor for coupling to a second coupling means on a pulling tool, said mattress border comprising:

border material having an inner and an outer surface, a pair of spaced first apertures in said border material, a grommet attached to said border material to surround each said first aperture, a flexible back strap, located on the inside surface of said material, said back strap having a pair of second apertures, said back strap being attached to said border material by each grommet and located thereby so that each second aperture aligns with a first aperture to form an aligned set of apertures, said method comprising the steps of, bending said back strap and said material into a U shape so that said inside surface is convex outward and so that said first apertures are aligned, inserting said pulling tool through said aligned apertures, coupling said second coupling means to the first coupling means, using said tool to pull said handle so that said one of said anchors passes through said first aligned apertures.

7. In the method as claimed in claim 6 wherein said back strap includes a plurality of clamping surfaces adjacent each aperture, and wherein said method includes, prior to bending said back straps the step of attaching clamping means to each of said pluralities and using said clamping means to achieve said bending.

* * * * *